US008112008B2

(12) United States Patent
Sugaya

(10) Patent No.: US 8,112,008 B2
(45) Date of Patent: Feb. 7, 2012

(54) IMAGE FORMING APPARATUS

(75) Inventor: Hajime Sugaya, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/152,596

(22) Filed: Jun. 3, 2011

(65) Prior Publication Data

US 2011/0229174 A1 Sep. 22, 2011

Related U.S. Application Data

(63) Continuation of application No. 11/858,553, filed on Sep. 20, 2007, now Pat. No. 7,978,988.

(30) Foreign Application Priority Data

Sep. 25, 2006 (JP) ..... 2006-259498

(51) Int. Cl.
*G03G 15/08* (2006.01)

(52) U.S. Cl. ..... 399/27; 399/254

(58) Field of Classification Search ..... None
See application file for complete search history.

(56) References Cited

U.S. PATENT DOCUMENTS

| | | | |
|---|---|---|---|
| 4,977,428 | A | 12/1990 | Sakakura et al. |
| 5,530,527 | A | 6/1996 | Fukasawa et al. |
| 2006/0165423 | A1 | 7/2006 | Nishitani et al. |

FOREIGN PATENT DOCUMENTS

| | | | |
|---|---|---|---|
| JP | 01-297677 | A | 11/1989 |
| JP | 2002-369588 | A | 12/2002 |
| JP | 2004-118028 | A | 4/2004 |

*Primary Examiner* — David Gray
*Assistant Examiner* — Roy Y Yi
(74) *Attorney, Agent, or Firm* — Fitzpatrick, Cella, Harper & Scinto

(57) ABSTRACT

An image forming apparatus, which has a plurality of image forming units, comprises a plurality of cartridges adapted to supply developer; a plurality of supply members adapted to supply developer to the image forming units from a plurality of the cartridges; a drive unit adapted to drive a plurality of the supply members; and a control unit adapted to supply developer from a plurality of the cartridges by selectively operating a plurality of the supply members based on the amount of developer accommodated in the cartridges.

6 Claims, 11 Drawing Sheets

FIG. 10

HIGH ← PRIORITY → LOW

| ORDER OF PRIORITY | 1 | 2 | 3 | 4 |
|---|---|---|---|---|
| AMOUNT OF REMAINING TONER IN PROCESS CARTRIDGE | 20% | 50% | 70% | 80% |
| IMAGE FORMING STATION | C(Cyan) | Y(Yellow) | M(Magenta) | K(Black) |

IMAGE FORMING APPARATUS

This application is a divisional of U.S. patent application Ser. No. 11/858,553, filed Sep. 20, 2007.

BACKGROUND OF THE INVENTION

1. Field of the Invention

The present invention relates to image forming apparatuses that use electrophotographic techniques. Here, image forming apparatus refers to an apparatus that forms an image on a recording medium using electrophotographic image forming. For example, electrophotographic copiers, electrophotographic printers (for example, laser beam printers, LED printers and the like), facsimile machines, and word processors and the like are included.

2. Description of the Related Art

Conventionally, a structure such as that shown in FIG. 2 is known in image forming apparatuses that use an electrophotographic process for forming a full color image constituted by a plurality of toner images. A developing unit 8 (8Y, 8M, 8C, and 8Bk), a photosensitive member 5 (5Y, 5M, 5C, and 5Bk), which is a first image carrier, and a process unit that acts on the photosensitive member for each color are set as an image forming unit (hereinafter, referred to as "image forming station") for each color. There are image forming apparatuses having configurations in which these stations are arranged in a line in opposition to a second image carrier (also referred to as an "intermediate transfer member") 12, then toner images of each color are superimposed and transferred onto the second image carrier 12, where they are then transferred together onto a recording material 2 by a secondary transfer unit 18. This method is widely used at present since it is possible to have a large number of sheets on which an image is formed per unit of time when forming color images.

The image forming station has at least a process cartridge 22 (22Y, 22M, 22C, and 22Bk). Furthermore, a toner cartridge 11 (11Y, 11M, 11C, and 11Bk) and a toner supply unit 23 (23Y, 23M, 23C, and 23Bk) are provided to supply toner to the image forming station. Then, a configuration is employed that uses a motor as a supply unit drive source (drive unit) for carrying out a rotational action of an agitator member that agitates the toner inside the process cartridge and an action of supplying toner from the toner cartridge to the process cartridge. Here, the process cartridge 22 (22Y, 22M, 22C, and 22Bk) is constituted by the first image carrier 5 (5Y, 5M, 5C, and 5Bk), a charging unit 7 (7Y, 7M, 7C, and 7Bk) that charges the image carrier, and the developing unit 8 (8Y, 8M, 8C, and 8Bk) that supplies toner as a developer to the image carrier. The toner accommodated in the toner cartridge 11 (11Y, 11M, 11C, and 11Bk) as a developer is supplied to the process cartridge by the toner supply unit 23 (23Y, 23M, 23C, and 23Bk).

In regard to the cartridges used in image forming apparatuses, there is a tendency to increase the capacity of toner accommodated in the cartridges since it is common for large quantities of sheets to be printed out in keeping with the increased speeds of image forming apparatuses. And in cartridges having a large toner capacity, there is a tendency for a phenomenon (hereinafter referred to as "packing") to occur of the toner compacting such that the density of the accommodated toner increases approximately 30 to 40%. Occurrences of this packing phenomenon are caused by such factors as long periods of nonuse and vibration of the cartridge while in a same posture during transportation. When this packing phenomenon occurs there is an increased rotational load on the agitator member that agitates the toner and the toner supply unit 23, and depending on the state of the packing, rotation of the agitator member may become difficult and for example it is possible that the agitator member itself will become damaged. Furthermore, it is also conceivable that the motor, which is the drive system, will lose synchronization. (Here "density" signifies an amount of toner per unit of volume.)

As a solution to this problem, an apparatus has been proposed (Japanese Patent Laid-Open No. H01-297677) in which an agitator member is rotated slowly by setting a rotation velocity of a motor at a velocity lower than an ordinary rotation velocity at a time of initial rotation of the motor, which rotationally drives an agitator that agitates toner. By causing the agitator member to rotate slowly there is no sudden application of load even when the packing phenomenon is occurring. Accordingly, packing can be alleviated without damaging the agitator member or causing the motor to lose synchronization.

However, problems such as the following arise when the initial rotation velocity is slower than the ordinary rotation velocity. Namely, it is necessary to provide a separate control circuit for carrying out a special action of causing the motor to rotate at a speed different from the time of initial rotation or to provide a speed-varying mechanism at the drive transmission mechanism between the motor and the agitator member. Adding configurations such as these is a cause of cost increases for the entire apparatus.

On the other hand, there is increased noise accompanying greater speeds in image forming apparatuses, such as driving noises when driving the apparatus and vibration noises produced by the charging member or the like vibrating due to the voltage (AC voltage component) applied to a conductive roller, which is a charging member. That is, a problem arises when speeds are increased in image forming apparatuses in that there are increased noises harsh to the ear of the user. In particular, since the user is near the printer at times such as when power to the image forming apparatus is turned on or when a cartridge is being loaded, the user may feel discomfort in regard to the noises produced at those times.

As described above, along with increased speeds in image forming apparatuses, that is, increased processing speeds, there is increased torque for the motor that drives the image forming stations or the like in the image forming apparatus, and along with increased torque there is a tendency for noise produced during operation to increase.

Techniques such as the following are known for addressing this problem. In Japanese Patent Laid-Open No. 2004-118028, an initial operation such as when loading a process cartridge is operated at a second processing speed slower than a processing speed of an image forming mode in which an image is formed on a commonly used paper such as plain paper. That is, detection is carried out for a signal indicating that power to the image forming apparatus has been turned on, a signal indicating that a process cartridge has been loaded, or a signal corresponding to a level of compaction of developer that has been filled into a process cartridge. Then, when any of these signals is detected, selection is preformed such that the initial operation of the process cartridge is carried out at the second processing speed. That is, the load placed on the driving motor is reduced at times when there is a high probability the user is near the apparatus, for example, when turning on the power or when loading a process cartridge. In this way, noises such as the driving noise of the motor and the above-mentioned vibration noises can be reduced.

Furthermore, in Japanese Patent Laid-Open No. 2002-369588, a configuration is employed to prevent the motor from losing synchronization by switching the drive current of a stepping motor in response to load fluctuation. That is, the drive current for a stepping motor is switched in response to the stepping motor that drives some of the mechanical elements of the image forming apparatus and load produced when driving such some mechanical elements.

In this regard, in order to achieve device compactness and reduced costs in the color image forming apparatuses, a configuration is sometimes employed in which a motor is shared among a plurality of image forming stations as a drive source for the toner agitator members that agitate the toner and the toner supply units. In this case, use of a single motor is achieved through a configuration capable of selectively enabling or disabling transmission of drive between the motor, which is the drive source, and the various components, thus employing a configuration in which operation of the plurality of toner agitator members and toner supply units is performed selectively with the single motor.

However, in configurations where a motor is shared in this manner, there is a tendency for the causes of fluctuation and the range of fluctuation in the load on the motor to further widen due to such factors as the number of toner agitator members and toner supply units being operated simultaneously and the condition of the cartridges. That is, drive objects to be driven by the single motor increase and therefore the causes of load fluctuation increase and the range of load fluctuation becomes very large. Accordingly, it is necessary to have a motor that has a capacity to withstand high loads and a motor that has a capacity to tolerate fluctuation in the rotation velocity and fluctuations in the drive current. However, a motor such as this is high in cost and therefore there is a problem in that device cost reductions are hindered.

SUMMARY OF THE INVENTION

Accordingly, an object of the present invention is to suppress load fluctuation of a drive motor in an apparatus so as to enable sharing of the motor for carrying out an agitating action and a supply action of toner as a developer without increasing the cost of the drive motor. And also another object of the present invention is to provide an image forming apparatus in which the number of drive motors and associated drive mechanisms is reduced, cost reductions for the entire apparatus are achieved, and loss of synchronization of the motor and damage to components is prevented.

According to one aspect of the present invention, an image forming apparatus, which has a plurality of image forming units, comprises:

a plurality of cartridges adapted to supply developer;

a plurality of supply members adapted to supply developer to the image forming units from a plurality of the cartridges;

a drive unit adapted to drive a plurality of the supply members; and a control unit adapted to supply developer from a plurality of the cartridges by selectively operating a plurality of the supply members based on the amount of developer accommodated in the cartridges.

According to another aspect of the present invention, an image forming apparatus, which has a plurality of image forming units that have developing units accommodating developer, comprises:

a plurality of cartridges adapted to supply developer;

a plurality of supply members adapted to supply developer to the developing units from a plurality of the cartridges;

a drive unit adapted to drive a plurality of the supply members; and a control unit adapted to supply developer from a plurality of the cartridges by selectively operating a plurality of the supply members based on the amount of developer in the developing units.

According to still another aspect of the present invention, an image forming apparatus, which has a plurality of image forming units accommodating developer, comprises:

a plurality of cartridges adapted to supply developer;

a plurality of supply members adapted to supply developer to the image forming units from a plurality of the cartridges;

a single drive unit adapted to drive a plurality of the supply members; and a control unit adapted to supply developer from a plurality of the cartridges by selectively operating a plurality of the supply members based on the amount of developer in the image forming units and the amount of remaining developer in the cartridges.

Further features of the present invention will become apparent from the following description of exemplary embodiments (with reference to the attached drawings).

BRIEF DESCRIPTION OF THE DRAWINGS

FIG. 10 shows levels of priority of toner supply actions according to embodiment 4.

DESCRIPTION OF THE EMBODIMENTS

Hereinafter, illustrative and detailed description of preferred embodiments for implementing the present invention is given with reference to the accompanying drawings. Note that without specific description to the contrary, the scope of the present invention is not limited to the dimensions, materials, shapes, and relative arrangements of structural components described in the embodiments. Furthermore, in so far as there is no new description to the contrary, the materials and shapes and the like of members that have been initially described in the following description are the same as the initial description.

Figure 2:
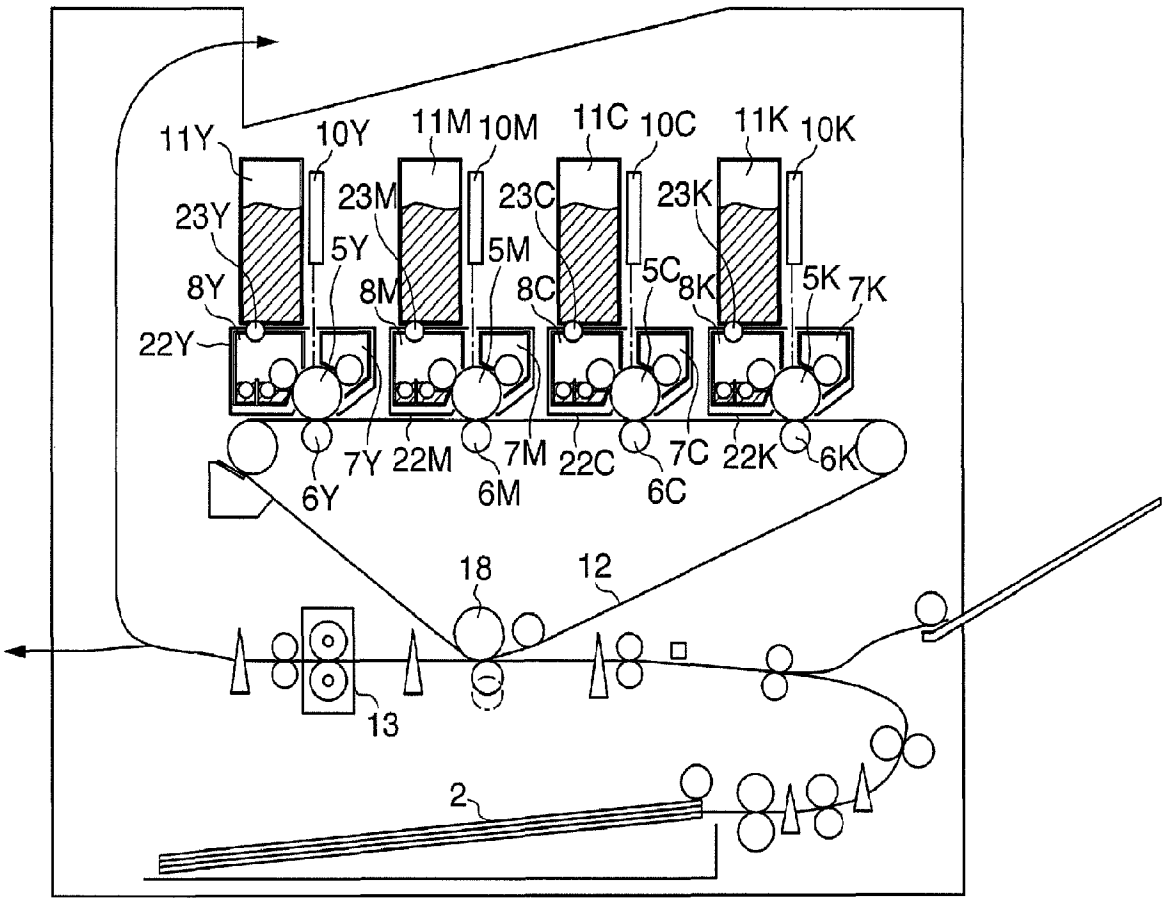
FIG. 2 shows a structural example of a laser beam printer, which is an image forming apparatus according to the present embodiment.

Structural Example of an Image Forming Apparatus According to the Present Embodiment FIG. 2 is a cross-sectional view showing an outline structure of an image forming apparatus according to the present embodiment. The image forming apparatus of the present embodiment is a color laser printer.

In the color laser printer of the present embodiment, electrostatic latent images are formed in the image forming stations based on image signals and the electrostatic latent images are developed to form visible images. These visible images are superimposed and transferred onto an intermediate transfer member to form a color image, then the color image further undergoes secondary transfer to a recording material, which is a recording medium, and then the color visible image undergoes fixing.

The image forming apparatus is configured by the image forming stations as image forming units, scanners 10Y, 10M, 10C, and 10K as exposure units, primary transfer units 6Y, 6M, 6C, and 6K, an intermediate transfer member 12, a paper feeding unit, a secondary transfer unit 18, a fixing unit 13 and the like. The image forming stations include photosensitive drums 5Y, 5M, 5C, and 5K as image carriers in each image station arranged side by side according to developer color, and process cartridges 22Y, 22M, 22C, and 22K, which include charging units (also referred to as chargers) 7Y, 7M, 7C, and 7K as charging units. And the process cartridges 22Y, 22M, 22C, and 22K include developing units (also referred to as developing devices) 8Y, 8M, 8C, and 8K as developing units and the scanners 10Y, 10M, 10C, and 10K as exposure units. And since the photosensitive drum, the charger, and the developing device deteriorate with use, each process cartridge is configured to be exchangeable (detachable) with respect to the image forming apparatus. Also, the toner supply units 23Y, 23M, 23C, and 23K that supply toner as a developer in the process cartridges and the toner cartridges 11Y, 11M, 11C, and 11K including toner vessels that accommodate toner are exchangeable (detachable) with respect to the image forming apparatus. Each toner cartridge is exchanged when it becomes empty of toner.

Here, there is one motor for driving the toner supply units 23Y, 23M, 23C, and 23K. That is, all the cartridges are driven by a single shared motor. The motor is connected to the respective toner supply units through a drive transmission mechanism not shown in the diagram. And the toner supply units 23Y, 23M, 23C, and 23K are configured so as to be capable of being driven separately and selectively by the drive transmission mechanism.

Structural Example of Toner Supply Unit

Figure 3:
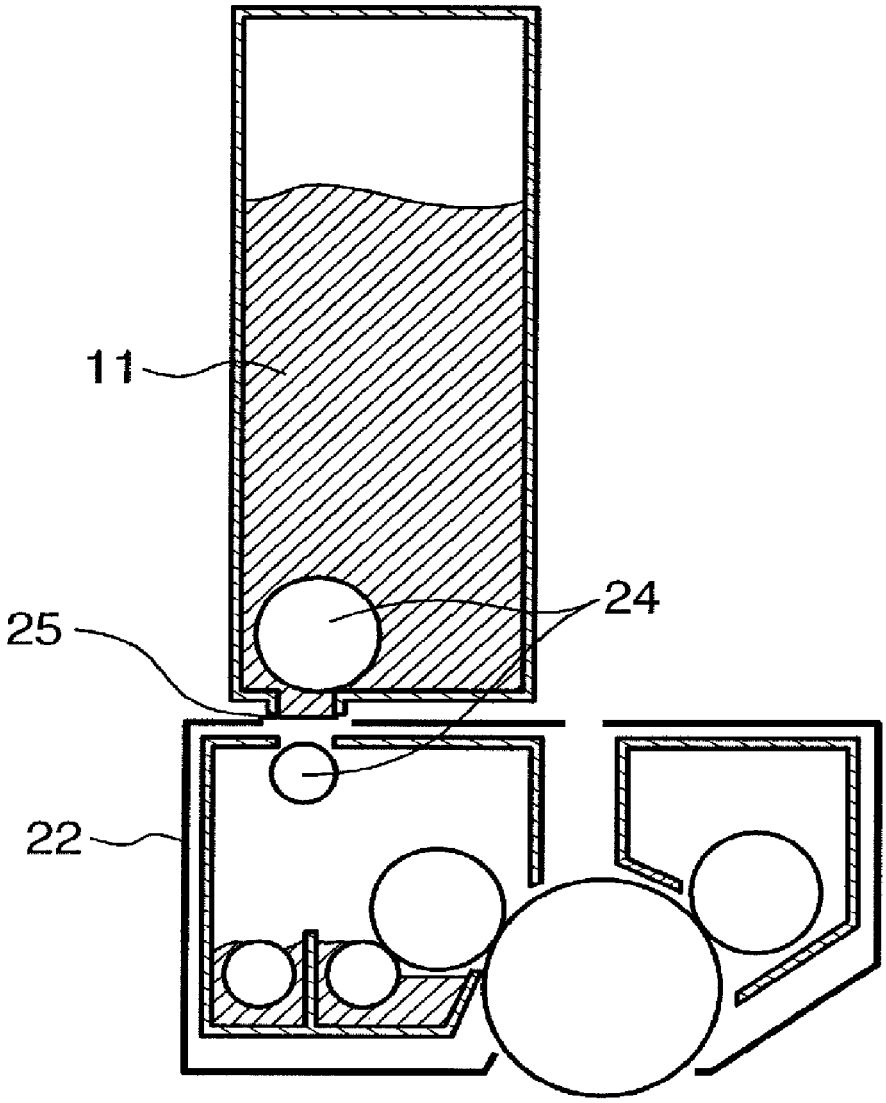
FIG. 3 shows a configuration example of toner supply units according to the present embodiment.

FIG. 3 is a cross-sectional view showing an outline configuration of a toner supply unit. The toner cartridge 11 and the process cartridge 22 are provided with toner agitation/supply screws 24 as supply members for agitating and supplying toner and a toner supply shutter 25 between the toner cartridge and the process cartridge, and a toner supply action is executed by driving these components with the motor.

Block Configuration Example of Toner Supply Control

Figure 1A:
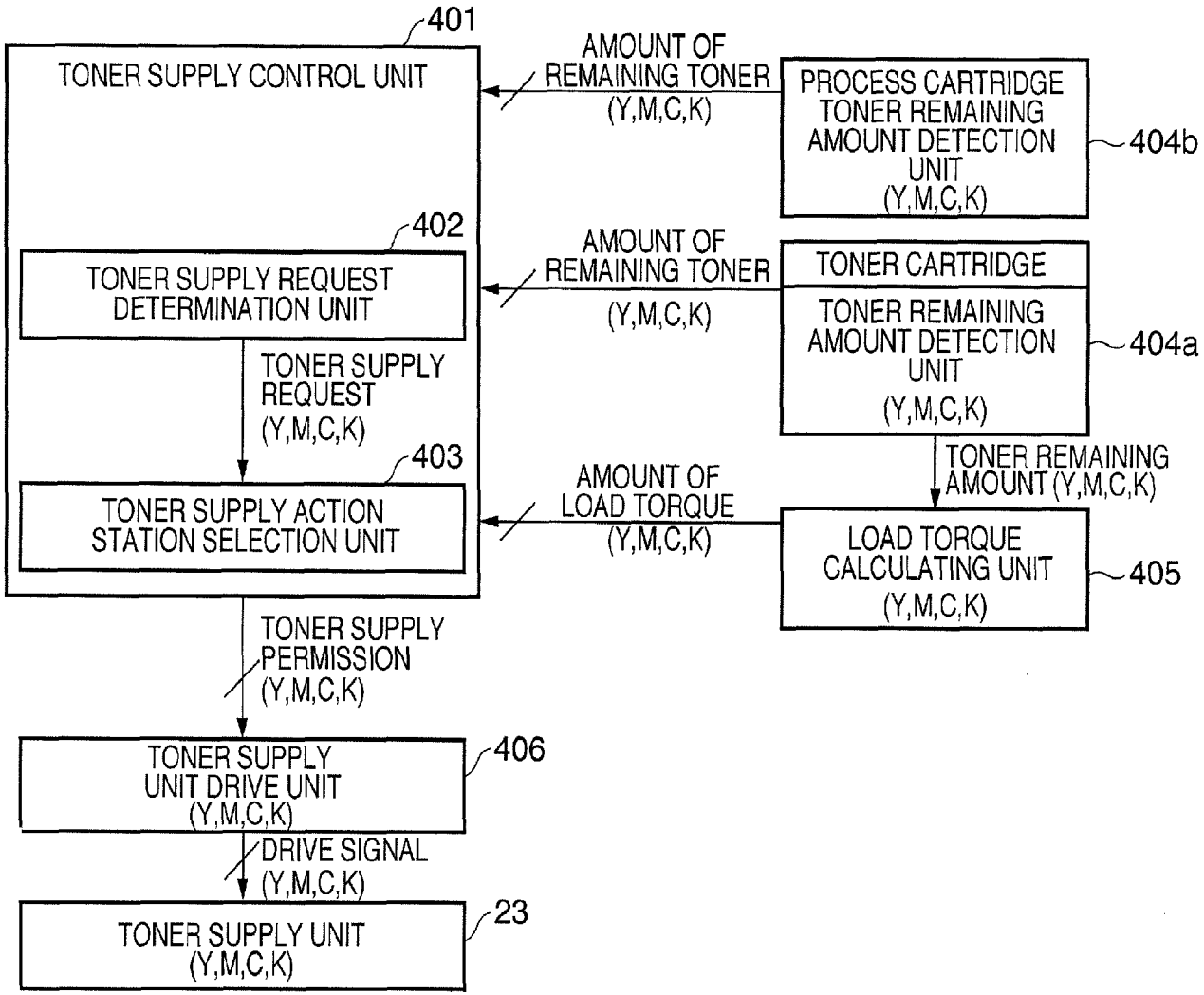
FIG. 1A is a block diagram relating to toner supply control according to the present embodiment.

FIG. 1A shows a block diagram of control relating to toner supply used in the present embodiment.

A toner supply control block is constituted by a toner supply control unit 401, toner remaining amount detection units 404, a load torque calculating unit 405, and a toner supply unit drive unit 406. The toner supply control unit 401 is provided with a toner supply request determination unit 402 and a toner supply action station selection unit 403. The toner supply request determination unit 402 determines whether or not toner supply is necessary in each image forming station and the toner supply action station selection unit 403 selects whether or not to actually permit toner supply to the station requesting toner supply. The toner remaining amount detection units 404 include a detection unit 404*a* that detects a toner remaining amount in the toner cartridge 11 and a detection unit 404*b* that detects a toner remaining amount in the process cartridge 22.

The detection units 404*a* and 404*b* are configured to calculate the amount of remaining toner in each of the respective image forming stations, and the load torque calculating unit 405 is configured to calculate an amount of load torque in each of the respective image forming stations. Furthermore, the toner supply unit drive unit 406 is configured to receive permission to supply to the toner supply unit 23 of each of the image forming stations and to produce drive signals independently for each image forming station.

The toner supply control unit 401 determines whether or not each of the image forming stations requires toner supply. If toner supply is required, then it references the amount of remaining toner in each cartridge using the detection units 404*a* and 404*b*. Following this, a toner supply request is sent to the toner supply action station selection unit 403 where a selection is made as to whether or not to actually permit supply to the requesting image forming station. In doing this, information of the amount of remaining toner in the cartridge and the amount of torque to be generated during toner supply is referenced as required using the detection units 404*a* and 404*b* and the load torque calculating unit 405. Information of the station to which toner supply is permitted is given to the toner supply unit drive unit 406 by the toner supply action station selection unit 403. Drive signals for the station that is permitted toner supply are generated in the toner supply unit drive unit 406 and the actual toner supply action is carried out by the toner supply unit 23.

Example of Detecting the Amount of Remaining Toner

In regard to techniques for detecting the amount of remaining toner, a technique is known as an optical detection technique in which the amount of remaining toner is detected by detecting a time in which light penetrates inside the cartridge. This technique is a method that involves causing a light to penetrate inside the cartridge during toner agitation, reading the light that penetrates in a fixed period, then detecting the remaining amount in the cartridge using the time in which the penetrating light was read or a ratio of the times of penetrating light and non-penetrating light.

Furthermore, there is a technique of estimating the toner amount in the cartridge using a number of times of action (number of rotations or rotation time) of the toner supply unit in the toner cartridge and calculating the amount of toner supply from the toner cartridge and an amount of toner consumption during image forming in the process cartridge. Also, there is a technique for detecting the amount of remaining toner involving providing a metal plate inside the toner cartridge or the process cartridge and measuring its capacitance. It should be noted that there are cases where the above-described techniques are combined or used selectively in order to more accurately detect the amount of remaining toner.

Hardware Configuration Example of Toner Supply Control

Figure 1B:
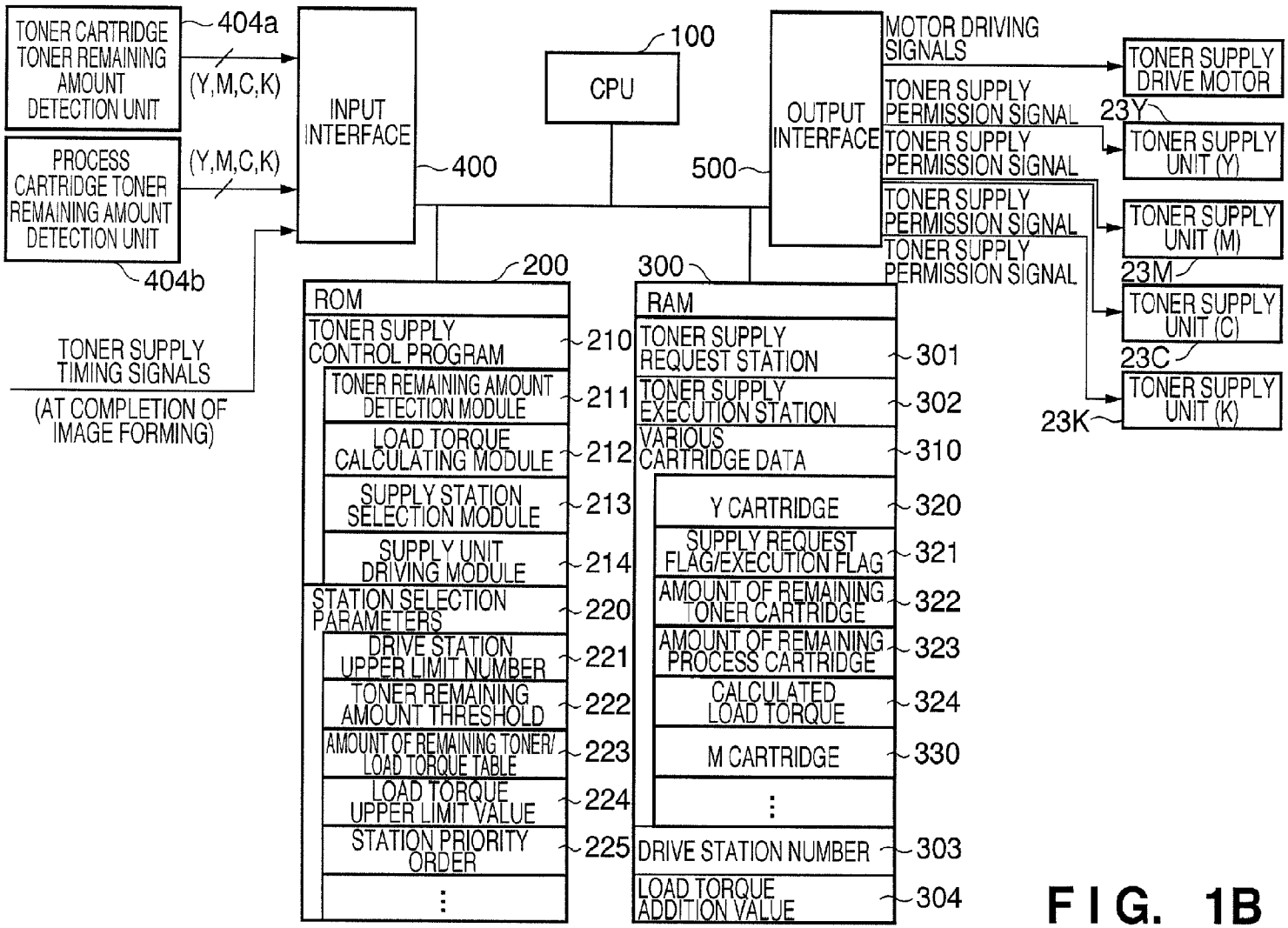
FIG. 1B shows a hardware configuration example that achieves toner supply control according to the present embodiment.

FIG. 1B shows a hardware configuration example that carries out toner supply control according to the present embodiment. It should be noted that FIG. 1B shows only structural elements having a strong association with the present embodiment while general-purpose structural elements or structural elements having a weak association are omitted from FIG. 1B.

In FIG. 1B, numeral 100 indicates a CPU for calculation control that coordinates toner supply control (this corresponds to numeral 401 in FIG. 1A). Numeral 200 indicates a ROM that stores programs of the action procedures of the CPU 100 and fixed parameters used in toner supply control. Numeral 300 indicates a RAM used for temporary storage when the CPU 100 carries out the programs of the ROM 200 and toner supply control while using the parameters therein.

A toner supply control program 210 corresponding to a flowchart shown below is stored in the ROM 200. The toner supply control program 210 includes modules such as an amount of remaining toner detection module 211, a load torque calculating module 212, a supply station selection module 213, and a supply unit driving module 214. Furthermore, the ROM 200 stores parameters 220 used for station selection. For example, the station selection parameters 220 include an upper limit number 221 (used in embodiment 1) of drive stations and an amount of remaining toner threshold 222 (used in embodiment 2). Also included are an amount of remaining toner/load torque table 223 (used in embodiment 3), a load torque upper limit value 224 (used in embodiments 3 and 4), and a station priority order 225 (used in embodiment 4).

Stored in the RAM 300 as control parameters are a toner supply request station 301, a toner supply execution station 302, a drive station number 303 (used in embodiment 1), and a load torque addition value 304 (used in embodiments 3 and 4). Also held here as cartridge data 310 for each color are, in a Y cartridge 320 for example, a supply request flag/execution flag 321, an amount of remaining toner cartridge 322, an amount of remaining process cartridge 323, and calculated load torque 324. It should be noted that description beyond an M cartridge data 330 is omitted.

Figure 5:
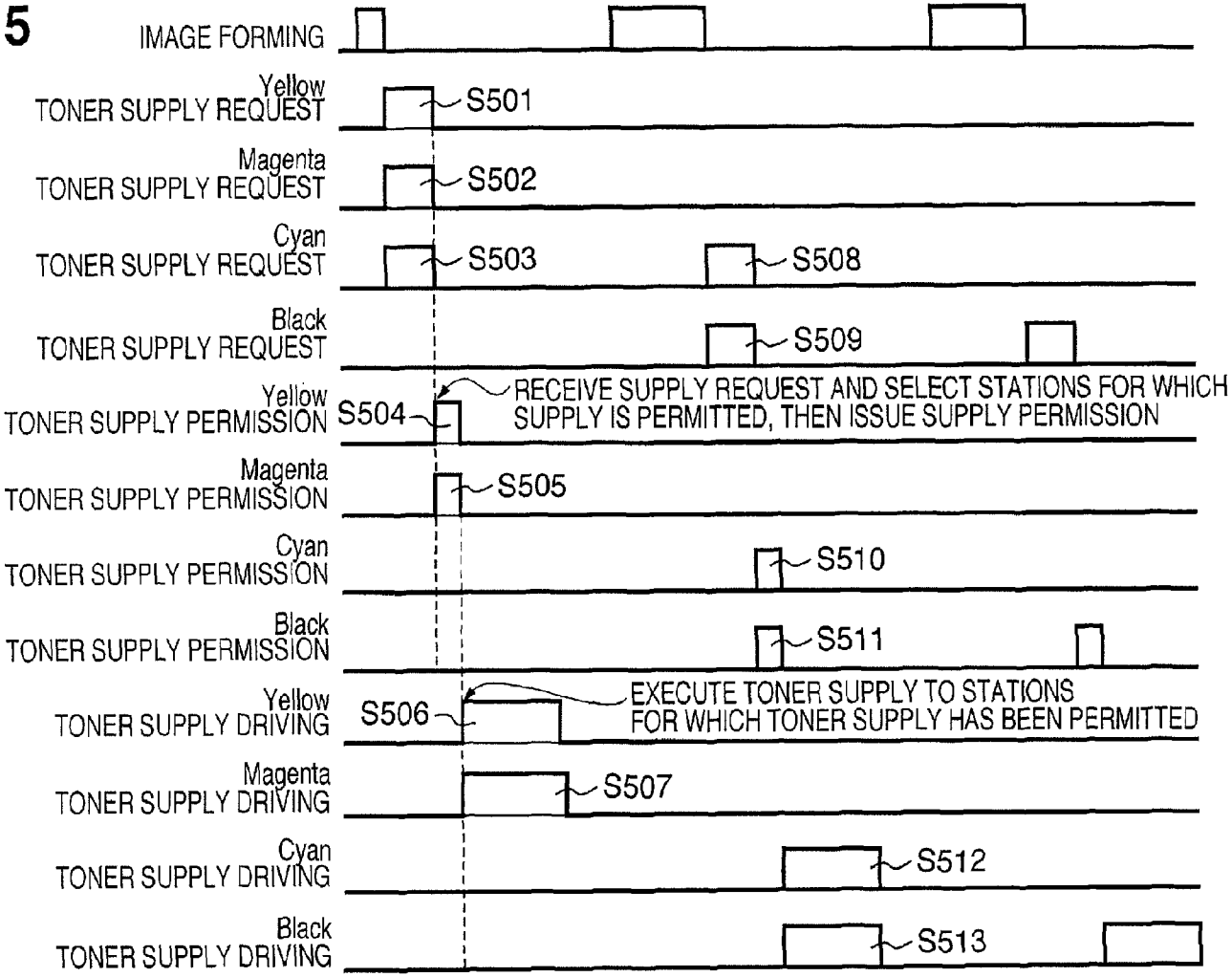
FIG. 5 is a timing chart illustrating an action example according to embodiment 1.

Numeral 400 indicates an input interface into which information used in toner supply control is input. Values of remaining toner amounts from the detection unit 404*a* of the toner cartridge, values of remaining toner amounts from the detection unit 404*b* of the process cartridge, and signals for controlling the timing of toner supply are input through the input interface 400. As shown in FIG. 5, signals indicating a completion of image forming processing are used as toner supply timing signals.

Numeral 500 indicates an output interface that outputs control signals for toner supply control. Output through the output interface 500 are motor driving signals that control the drive motor shared by the toner supply units of all the colors and permission signals that permit a supply action of each of the toner supply units 23Y, 23M, 23C, and 23K.

Based on data of remaining toner amounts data obtained through the input interface 400, the CPU 100 uses the RAM 300 as a work area and selects the toner supply unit to be driven in accordance with the programs and parameters stored in the ROM 200. A toner supply unit that has been selected is driven via the output interface 500.

Toner Supply Control in Embodiment 1

Each time image forming is to be carried out, the image forming apparatus of the present embodiment determines whether or not to supply toner in each of the image forming stations.

When determining the necessity of toner supply for the plurality of image forming stations, (1) if the number of image forming stations requiring toner supply is not greater than a number that can be driven simultaneously, then selection signals that permit toner supply are issued to all the image forming stations and toner supply actions are executed. On the other hand, (2) if the number of stations requiring toner supply is a number greater than the number that can be driven simultaneously, then only the number that can be driven are selected from among the stations requiring toner supply. Then selection signals that permit toner supply are issued to the selected image forming stations and toner supply actions are executed. Any station that has been determined to require toner supply but for which toner supply could not be executed again requests execution of toner supply at a next time of image forming.

The present embodiment is configured such that toner supply to all the stations is driven by a single shared motor. For the present embodiment it is assumed that it is possible to supply toner simultaneously to two image forming stations. It should be noted that the number of image forming stations to which toner can be supplied simultaneously is variable due to conditions such as motor capabilities and the like. After the forming of a toner image is completed by the image forming station, a determination is carried out in timing with commencement of toner supply as to whether or not toner supply is required to the process cartridge based on the amount of remaining toner or the amount of toner consumed during image forming. For example, if a toner supply action is required by only the process cartridge 7K, then the toner supply action is carried out for the process cartridge 7K since there is only one station for which the toner supply action is to be executed.

Furthermore, if toner supply is required by three process cartridges 7Y, 7M, and 7C, then toner supply actions are carried out for two of these, the process cartridges 7Y and 7M, since simultaneous supply actions are possible only for two image forming stations. The process cartridge 7C is then determined to require toner supply at the next image forming, and if there is another process cartridge that newly requires toner supply, then toner supply is executed jointly with that cartridge.

Action Procedure Example of Embodiment 1

Figure 4:
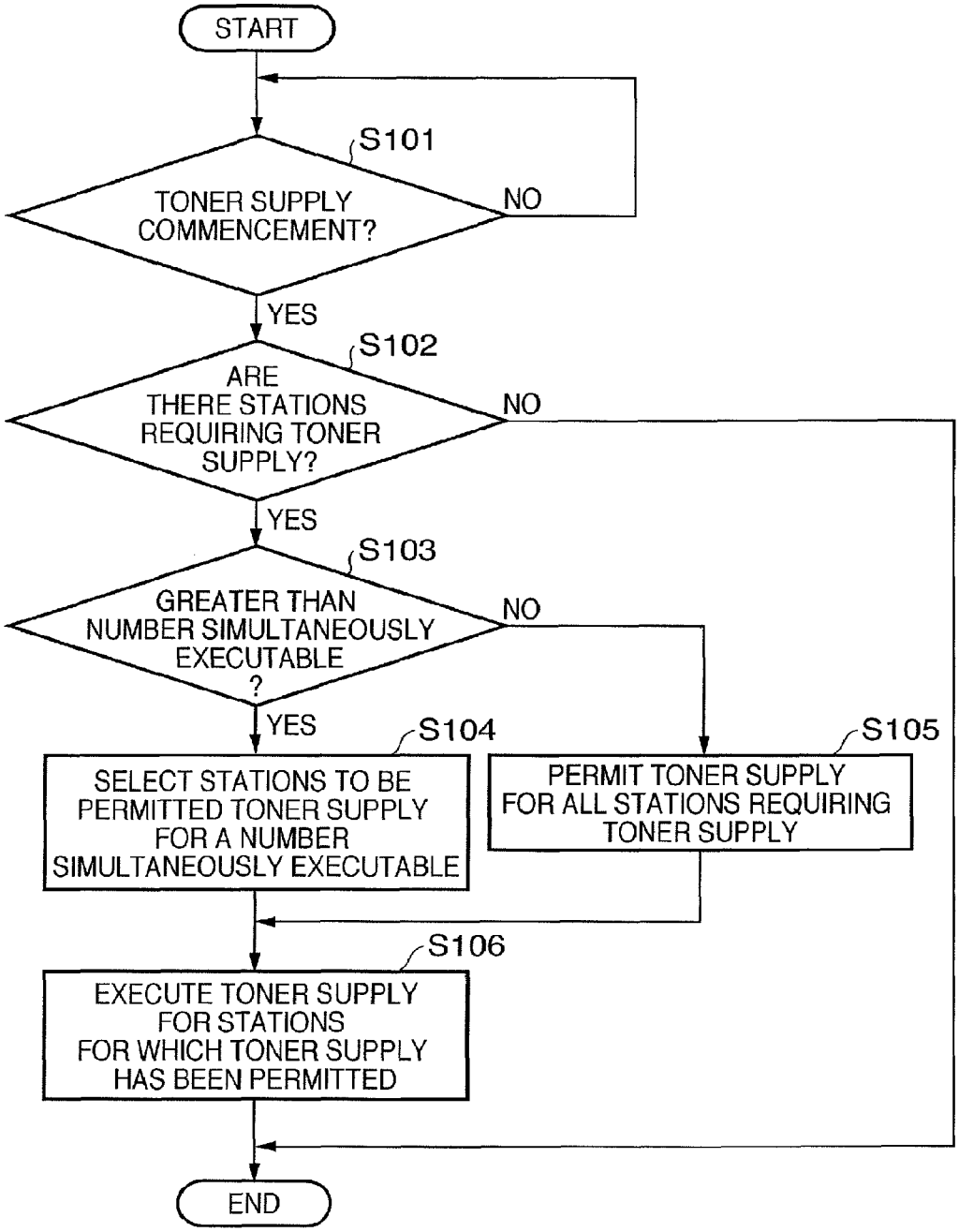
FIG. 4 is a flowchart illustrating an action procedure example according to embodiment 1.

FIG. 4 shows a flowchart of a toner supply action procedure example according to the present embodiment. At the time of toner supply commencement (S101), a determination is made (S102) of the image forming stations requiring toner supply, and a determination is made (S103) as to whether or not the number of image forming stations requiring toner supply is not greater than the number capable of being executed simultaneously. If the number of image forming stations requiring toner supply is not greater than the number capable of being executed simultaneously, then a toner supply action is permitted (S105) for all of these. On the other hand, if the number of stations requiring toner supply is greater than the number capable of being executed simultaneously, then stations are selected such that toner supply actions are carried out only for the number capable of being executed simultaneously from the process cartridges requiring toner supply and toner supply is permitted (S104).

After the determination of toner supply permission has finished, toner supply is executed (S106) for the stations that have received toner supply permission.

Any station for which toner supply was not executed is again determined to require toner supply at the time of the next image forming and toner supply is executed.

Action Timing Example of Embodiment 1

FIG. 5 shows a timing chart of the toner supply action according to the present embodiment.

After image forming is finished, a determination is made as to whether or not toner supply is required in each of the image forming stations, and toner supply requests are issued (S501 to S503). Following this, stations for which toner supply is to be permitted are selected for a number capable of being driven simultaneously in response to the toner supply requests, and toner supply permissions are issued (S504 and S505) to a magenta and a yellow station. Toner supply actions are executed (S506 and S507) for the issued toner supply permissions.

After the completion of the next image forming, a toner supply request is issued again (S508) for a cyan station, for which toner supply was not permitted. Stations for which toner supply is to be permitted are selected including the newly issued supply requests (S509) for a number capable of being driven simultaneously, and toner supply permissions are issued (S510 and S511) to the cyan and a black station. Then toner supply is executed (S512 and S513).

Effect of the Embodiment 1

By carrying out the above-described control, load torque increases can be suppressed by suppressing the number of stations to which toner supply is carried out simultaneously to not greater than a fixed number.

Toner Supply Control in Embodiment 2

In embodiment 1, load torque increases were suppressed by limiting the number of stations for which toner supply was to be driven simultaneously to a fixed number regardless of the state of each cartridge. However, the load torque produced by a toner supply action varies depending on the state of the cartridges targeted for the supply action.

In the present embodiment, when in a fixed period after the loading of a new cartridge, which has a probability that the torque it produces will be large, or when the amount of remaining toner in a toner cartridge is not less than a fixed amount, a limit is applied to the toner supply action for the load torque to be produced at the time of the toner supply action. By this process, load torque increases are suppressed.

As an example, consider that until the toner remaining amount is 90% or less, a higher than usual load torque is applied. Under this condition, assume that the toner cartridges 11Y, 11M, and 11C have remaining amounts of 70% and the toner cartridge 11K has a remaining amount of 100% immediately after being loaded. In this case, control is performed such that the toner supply actions for other stations are not permitted when a toner supply action is to be carried out by the toner cartridge 11K.

Action Procedure Example of Embodiment 2

Figure 6:
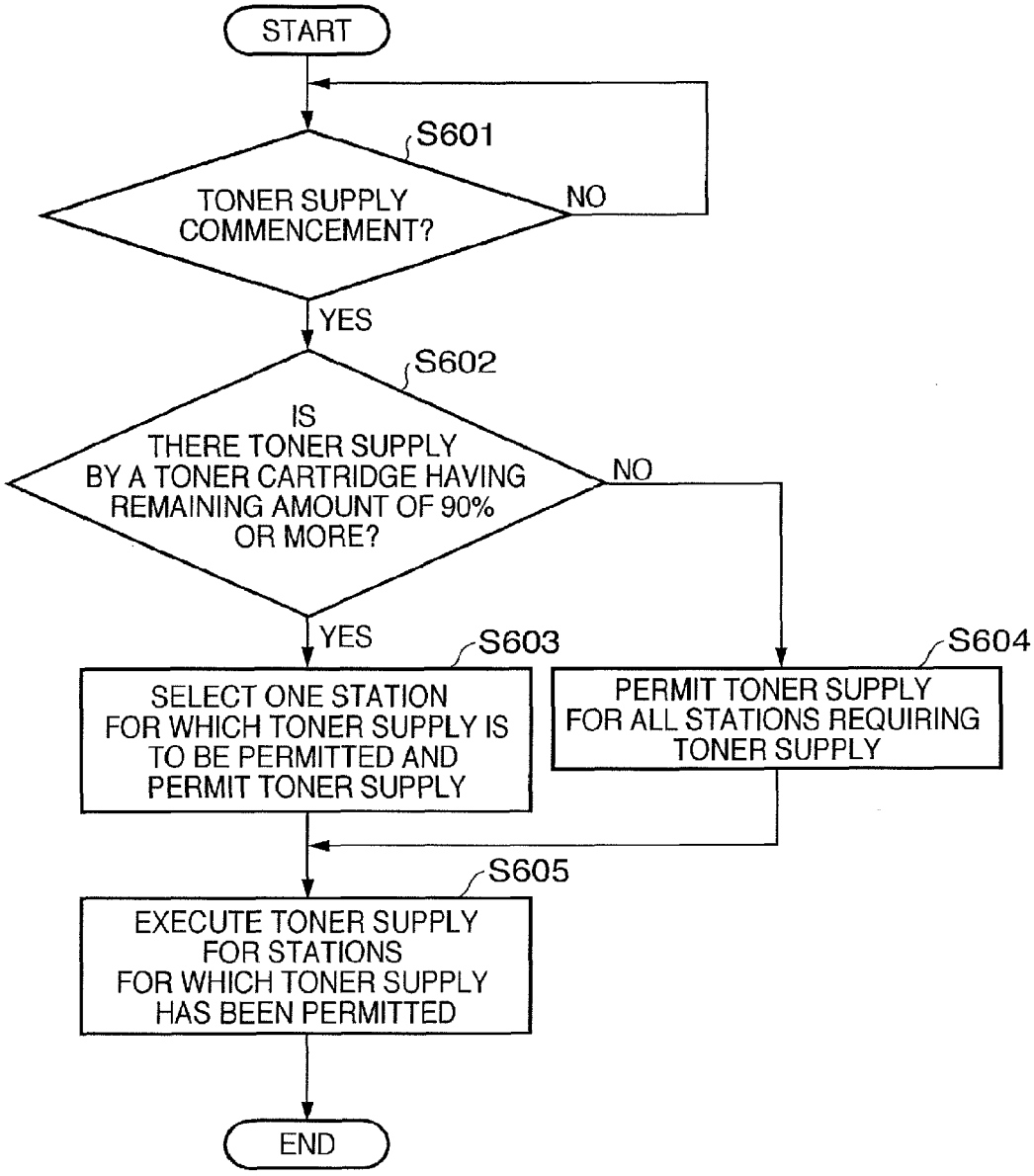
FIG. 6 is a flowchart illustrating an action procedure example according to embodiment 2.

FIG. 6 shows a flowchart of a processing procedure example of the present embodiment.

At the time of commencement of the supply action (S601), a check is performed (S602) as to whether or not the supply action is to be carried out for a toner cartridge having a remaining amount of 90% or more. If toner supply is to be carried out for a toner cartridge having a remaining amount of 90% or more, then a single station is selected therefrom and the toner supply action is permitted while toner supply is not permitted (S603) for the other stations. On the other hand, if there is no cartridge having a remaining amount of 900 or more among the toner cartridges for which toner supply is to be executed, then all the toner supply actions are permitted (S604).

When selection of stations for which toner supply is permitted has finished, toner supply is carried out (S605) only for the stations that have toner supply permission.

The selection of stations for which toner supply is to be permitted can be achieved giving opportunities for toner supply equally to the stations by enabling a rotation for each time of a supply action. That is, in a case where the cartridges 11K, 11Y, and 11M have remaining amounts of 90% or more for example, the order is rotated in a manner such as 11K→11Y→11M→11K.

Another Action Procedure Example of Embodiment 2

The present embodiment has been configured such that control is executed of the selection of stations for which toner supply is to be permitted only when there is a toner supply request from an image forming station that contains a toner cartridge having a remaining amount of 90% or more. However, this may also be configured such that, when there is a toner cartridge having a remaining amount not less than a fixed amount, regardless of whether or not there is a toner supply action for that station, each time toner supply is executed, an image forming station for which toner supply is permitted is set. In this case, an equivalent effect can be achieved in regard to load torque increases with very simple control by performing control such that the number of stations for which toner supply is normally to be executed simultaneously is not greater than a fixed number of stations.

Figure 7:
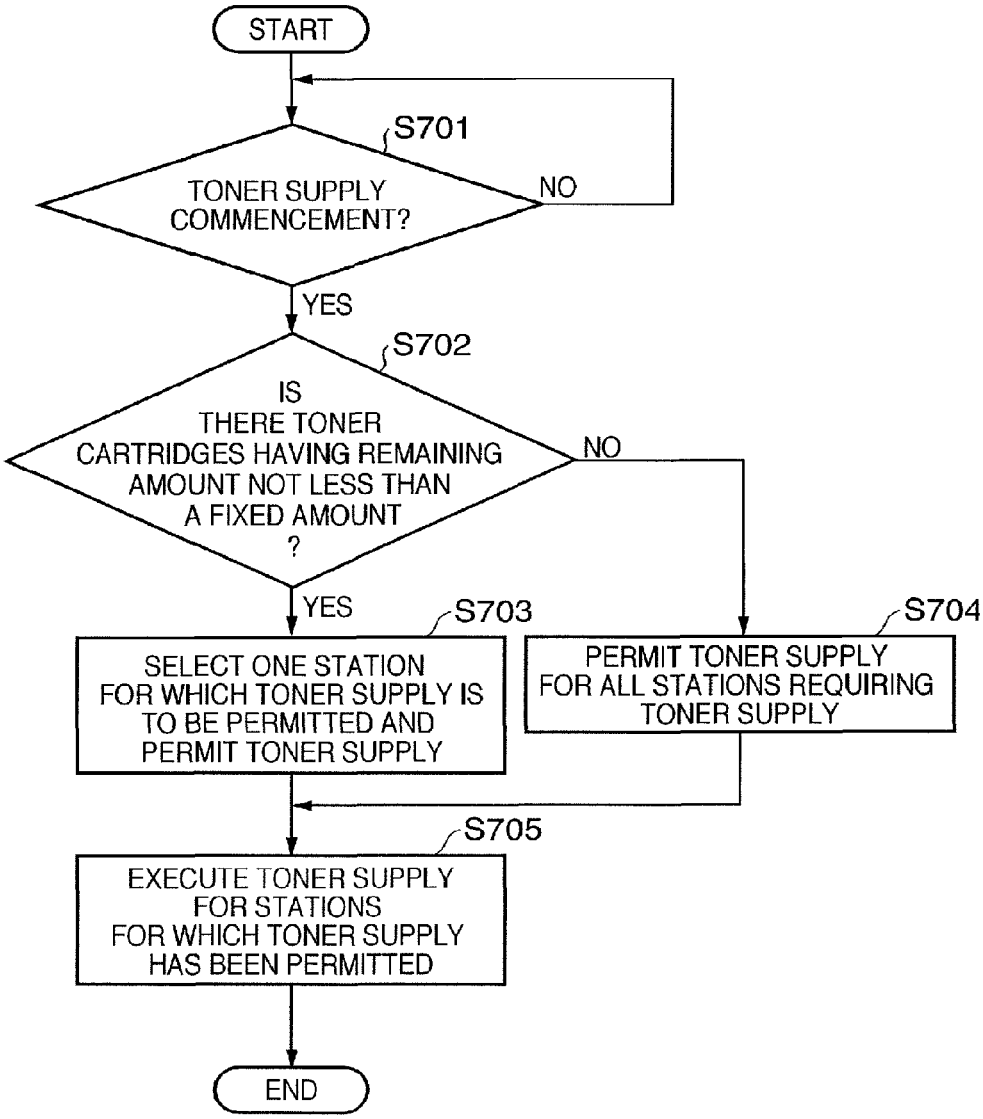
FIG. 7 is a flowchart illustrating an action procedure example in a case in which continuous toner supply is restricted when there is a high load cartridge according to embodiment 2.

FIG. 7 shows a flowchart relating to a toner supply action according to the present embodiment. It should be noted that a difference from FIG. 6 is only a determination criterion at step S702. That is, the check (S602) in FIG. 6 as to whether or not a supply action is to be carried out for a toner cartridge having a remaining amount of 90% or more is set to a check (S702) that is performed as to whether or not there is a toner cartridge having a remaining amount not greater than a fixed amount. The other steps are in common and therefore description is omitted.

Effect of the Embodiment 2

With the above-described control, load torque increases can be suppressed by limiting the simultaneous driving for toner supply immediately after the loading of a toner cartridge, which has a probability increasing the load torque, or when the amount of remaining toner in the toner cartridges is not less than a fixed amount.

Toner Supply Control in Embodiment 3

In embodiment 2, a determination was made as to whether or not to restrict toner supply in response to the remaining amounts in the toner cartridges. In the present embodiment, the load torque produced by the amount of remaining toner in the toner cartridge during toner supply is quantified as a proportion of a maximum load torque the motor can tolerate. In this way, control is carried out very flexibly in response to load torque variations.

In the image forming apparatus according to the present embodiment, the amount of remaining toner is associated with an allowed load torque as follows. When the amount of remaining toner in the toner cartridge is 90% or more, the load torque produced during a toner supply action at that station is set to 70% of the allowed load torque of the motor. When the amount of remaining toner is less than 90% but at least 70%, the load torque produced is set to 50% of the allowed load torque of the motor. When the amount of remaining toner is less than 70% but at least 50%, the load torque produced is set to 30% of the allowed load torque of the motor. When the amount of remaining toner is less than 50%, the load torque produced is set to 20% of the allowed load torque of the motor. This can be listed as follows.

Amount of remaining toner 90% or more: 70% of motor's allowed load torque

Amount of remaining tonerless than 90% to at least 70%: 50% of motor's allowed load torque Amount of remaining tonerless than 70% to at least 50%: 30% of motor's allowed load torque Amount of remaining tonerless than 50%: 20% of motor's allowed load torque For example, in an image forming apparatus in which the remaining amount of the toner cartridge 11Y is 40%, the remaining amount of the toner cartridge 11M is 45%, the remaining amount of the toner cartridge 11C is 40%, and the remaining amount of the toner cartridge 11C is 75%, control is performed as follows.

In this case, the load torque applied by toner supply in 11Y is 20% of the allowed value, and the load torque produced is 20% in 11M, 20% in 11C, and 50% in 11K respectively. In a case where a determination is made that toner supply is required in all stations at a same timing, the stations for which toner supply is to be executed are determined as follows.

First, toner supply is permitted in the toner cartridge 11K. Following this, toner supply is permitted in order from the toner cartridge 11C and then 11M. At this point in time, the ratio of load torque produced to allowed load torque is 90%. Following this, when toner supply for the toner cartridge 11Y is permitted, the load torque produced becomes 110% and undesirably exceeds the amount of allowed load torque. For this reason, toner supply for 11Y is not permitted and toner supply in the toner cartridges 11K, 11C, and 11M are permitted and executed.

Action Procedure Example of Embodiment 3

Figure 8:
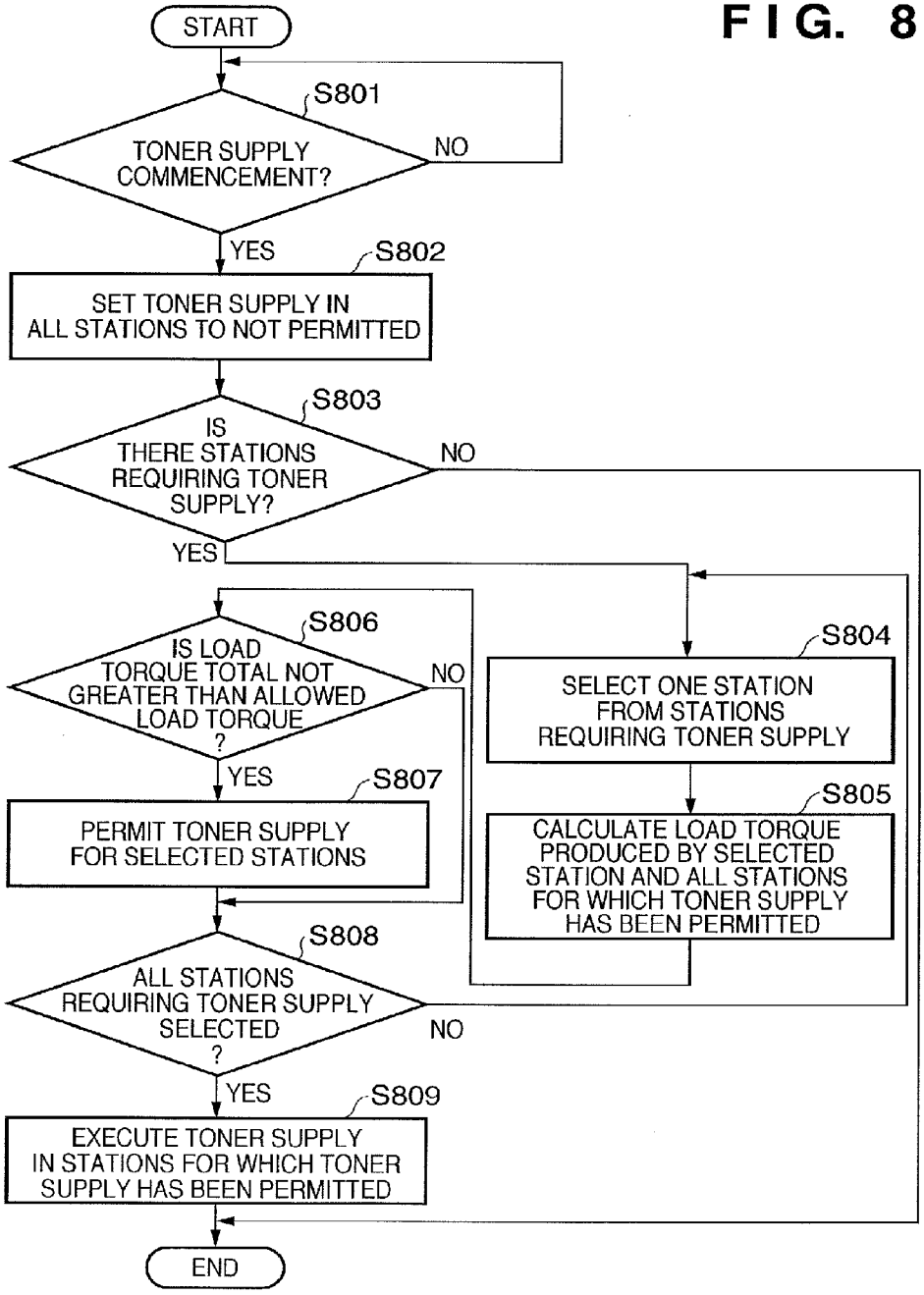
FIG. 8 is a flowchart illustrating an action procedure example according to embodiment 3.

FIG. 8 shows a flowchart regarding a toner supply action according to the present embodiment.

At the time of commencement of toner supply (S801), initially toner supply is set (S802) to be not permitted in all the image forming stations. Then, one station is selected (S804) from the image forming stations having a toner supply request. It should be noted that the selection is carried out in the order of toner cartridge 11K, 11C, 11M, and 11Y corresponding to the image forming stations. The amount of load torque produced is obtained from the remaining amount in the toner cartridge of the image forming station. The thus-calculated amount of load torque is added (S805) to the total of load torque produced by the image forming stations for which toner supply is currently permitted and compared (S806) with the allowable amount of load torque.

If this is not greater than the amount of allowable load torque, then the toner supply action of that image forming station is permitted (S807). If this is greater than the amount of allowable load torque, then the toner supply action of that image forming station is not permitted. The above is carried out (S808) in order for all the image forming stations having a toner supply request and after the permissibility of toner supply has been determined for all the image forming stations, toner supply is executed (S809) in the permitted image forming station(s).

In the present embodiment the determinations are made in the order of K, C, M, Y, but the selection technique is not limited to this order, and it is also possible to use a technique in which the priority order is dynamically changed for example so that the image forming stations are selected in a manner in which the number of image forming stations capable of simultaneous execution is maximized.

Effect of the Embodiment 3

A characteristic of the present embodiment is that when toner supply actions are executed simultaneously in selected image forming stations, the toner supply actions can be selected so that the load torque produced is always less than a maximum value of the motor's allowable load torque.

Toner Supply Control in Embodiment 4

In embodiments 1, 2, and 3, load torque increases were suppressed by selectively permitting toner supply without consideration of the amount of remaining toner in the process cartridges. However, in these embodiments, there are times when the toner inside the process cartridges is extremely small even when the remaining amount in the toner cartridge is large and there is a possibility of increased load torque. When toner supply is delayed at this time, there is a possibility of effects occurring such as the density of the toner image formed by that station becoming thinner. For this reason, priority must be given for toner supply to the process cartridge that has a low amount of remaining toner.

Accordingly, in the present embodiment, when toner supply actions are required in multiple stations simultaneously, control is executed to permit toner supply in order starting from the station having a process cartridge with the lowest amount of remaining toner. It should be noted that the image forming apparatus of the present embodiment is configured such that the toner remaining amounts in the process cartridges are detectable.

As in the example of embodiment 3, it is assumed that the remaining amount in the toner cartridge 11Y is 40%, the remaining amount in 11M is 45%, the remaining amount in 11C is 40%, and the remaining amount in 11K is 75%. In this case, the load torque applied by toner supply in 11Y is 20% of the allowed value, and the load torque produced is 20% in 11M, 20% in 11C, and 50% in 11K respectively.

Further still, in the present embodiment, the amount of remaining toner in the process cartridge 22Y is 50%, the amount of remaining toner in 22M is 70%, the amount of remaining toner in 22C is 20%, and the amount of remaining toner in 22K is 80%.

It should be noted that amounts of remaining toner in the process cartridges in the present embodiment and the priority level for the supply action of the image forming stations are shown in FIG. 10. In FIG. 10, the priority level of the process cartridge 22C, which has the lowest amount of remaining toner, is set highest. Then after this the order is 22Y, 22M, and 22K.

When supply actions are requested simultaneously in all the image forming stations, the permissibility of executing the toner supply actions is determined in an order such as that shown in FIG. 10 for example. The level of priority is changed and updated in response to the amounts of remaining toner in the process cartridges and is referenced by the CPU 100 when there is a toner supply request.

Under these conditions, in a case where a determination is made that toner supply is required in all stations, the stations for which toner supply is to be executed are determined as follows.

First, toner supply is permitted from the toner cartridge 11C to the process cartridge 22C, which has the lowest amount of remaining toner. Following this, toner supply is permitted in order in the toner cartridges 11Y and 11M, in the order of smallest amount of remaining toner in the process cartridges. At this point in time, the ratio of load torque produced to allowed load torque is 60%.

Following this, when toner supply for the toner cartridge 11K is permitted, the load torque produced becomes 110% and undesirably exceeds the amount of allowed load torque. For this reason, toner supply for 11K is not permitted and toner supply in the toner cartridges 11C, 11Y, and 11M is permitted and executed.

That is, in the present embodiment, the toner supply actions are carried out giving consideration to both the load torque based on the toner remaining amount in the toner cartridges and the level of priority for supply based on the amount of remaining toner in the process cartridges.

Action Procedure Example of Embodiment 4

Figure 9:
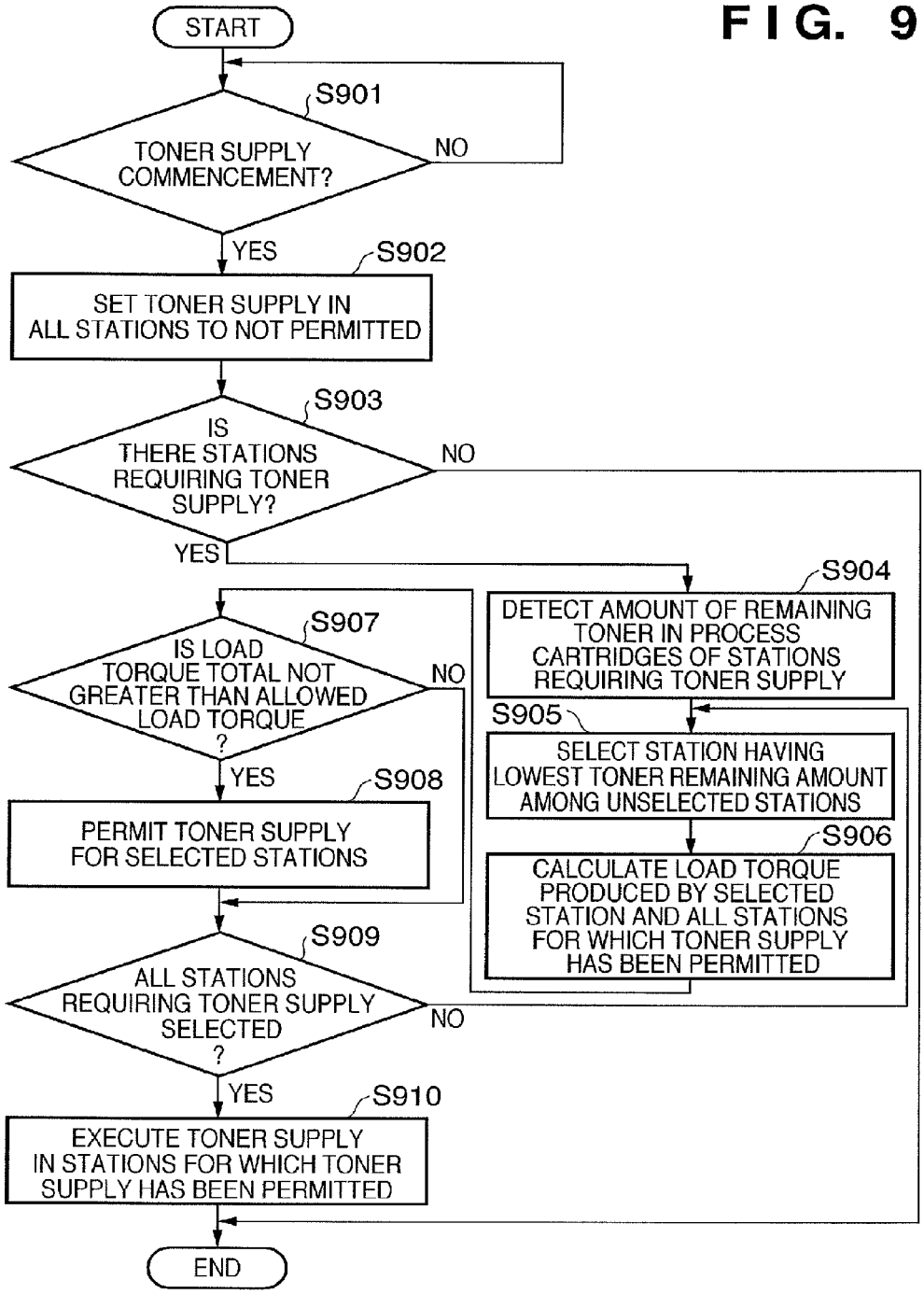
FIG. 9 is a flowchart illustrating an action procedure example according to embodiment 4.

FIG. 9 shows a flowchart regarding a toner supply action according to the present embodiment. A difference from embodiment 3 is that the level of priority for permitting toner supply is determined by the amount of remaining toner in the process cartridges.

At the time of commencement of toner supply (S901), initially toner supply is set (S902) to be not permitted in all the image forming stations. Then, a calculation is performed (S904) of the amounts of remaining toner in the process cartridges in the image forming stations having a toner supply request. Then, among unselected stations, the image forming station having the lowest amount of remaining toner is selected (S905). That is, the selections are carried out one by one in order of the process cartridges having the lowest amount of remaining toner. The amount of load torque produced is obtained from the remaining amount in the toner cartridge of this image forming station and the thus-calculated amount of load torque is added (S906) to the total of load torque produced by the image forming stations for which toner supply is currently permitted.

This is compared (S907) with the allowable amount of load torque. If this is not greater than the allowable load torque, then the toner supply action of that image forming station is permitted (S908). If this is greater than the amount of allowable load torque, then the toner supply action of that image forming station is not permitted. The above is carried out (S909) for all the image forming stations having a toner supply request and after the permissibility of toner supply has been determined for all the image forming stations, toner supply is executed (S910) in the permitted image forming station(s).

Effect of the Embodiment 4

With the above-described control, restrictions can be applied on simultaneous execution of toner supply while ensuring toner does not become insufficient in the process cartridges. Accordingly, it becomes possible to reduce the effect on toner images to be formed while also suppressing load torque increases at times of simultaneous execution of toner supply.

It should be noted that the present embodiment was described in regard to a case where there were toner supply requests simultaneously in all the image forming stations, but this is also applicable in cases where toner supply requests are not present for all the image forming stations.

It should be noted that the embodiments 1 to 4 were described independently, but examples in which the embodiments 1 to 4 are combined and examples in which other conditions are added are also possible, and these are also included in the present invention.

Furthermore, the present invention may be applied to a system constituted by multiple apparatuses (devices such as a host computer, an interface device, a reader, and a printer for example) and may also be applied to an apparatus constituted by a single device (a copier, a printer, or a facsimile machine or the like).

Furthermore, an object of the present invention may be achieved using recording medium (or a storage medium) on which program code of software that achieves the functionality of the foregoing embodiments is recorded. In these cases, the recording medium is provided to a system or a device, and a computer (or a CPU or an MPU) of the system or device can accomplish this by reading out and executing the program code stored on the recording medium. In this case, the actual program code that is read out from the recording medium achieves the functionality of the above-described embodiments, such that the recording medium on which the program code is recorded constitutes the present invention.

Furthermore, the functionality of the foregoing embodiments is achieved by having a computer execute the program code that has been read out. Furthermore, an operating system (OS) or the like that runs on a computer may carry out a part or all of the actual processing according to instructions of the program code. This includes cases where the functionality of the foregoing embodiments is achieved by this processing.

Further still, it is possible for the program code read out from the recording medium to be written onto a memory provided in an extension card inserted into the computer or an extension unit connected to the computer. Cases are also included in which subsequently, a CPU or the like provided in the extension card or extension unit carries out a part or all of the actual processing according to instructions of the program code such that the functionality of the foregoing embodiments is achieved by the processing thereof.

Furthermore, program data for achieving the functionality of the foregoing embodiments may be downloaded to a memory of a device itself from a CD-ROM that is set in the device itself or from an external supply source such as the Internet. The present invention also includes forms in which the functionality of the foregoing embodiments is achieved in this way.

When the present invention is applied to the above-described recording medium, it is preferable that program code corresponding to the flowcharts described earlier is contained on the recording medium.

As described above, with the present invention, increased costs as an apparatus are suppressed and it is possible to prevent loss of synchronization of the motor and damage to components.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-259498, filed Sep. 25, 2006, which is hereby incorporated by reference herein in its entirety.

What is claimed is:

1. An image forming apparatus, which has a plurality of image forming units, comprising:

a plurality of cartridges adapted to supply developer;

a plurality of supply members adapted to supply developer to the image forming units from the plurality of cartridges;

a drive unit adapted to drive the plurality of supply members; and a control unit adapted to control, on the basis of a load torque of the supply members to be applied to the drive unit, whether or not to drive at least two supply members of the plurality of supply members simultaneously.

2. The image forming apparatus according to claim 1, wherein the load torque to be applied to the drive unit is variable in accordance with the amount of developer accommodated in the plurality of cartridges.

3. The image forming apparatus according to claim 1, wherein the plurality of supply members are driven by a single drive unit.

4. The image forming apparatus according to claim 1, wherein the load torque to be applied to the drive unit is less when the amount of developer accommodated in the plurality of cartridges is lower, and wherein the load torque to be applied to the drive unit drives the plurality of supply members unless the load torque is greater than a predetermined maximum load torque that can be applied to the drive unit.

5. The image forming apparatus according to claim 1, wherein if the amount of developer accommodated in each of the plurality of cartridges is smaller than a predetermined amount that corresponds to a situation where the plurality of supply members should be driven one by one, the drive unit drives the plurality of the supply members simultaneously.

6. The image forming apparatus according to claim 1, wherein if the amount of developer accommodated in any one of the plurality of cartridges is greater than a predetermined amount that corresponds to a situation where the plurality of supply members should be driven one by one, the drive unit drives the plurality of the supply members one by one.

* * * * *